US006494268B1

(12) United States Patent
Ljungdahl et al.

(10) Patent No.: US 6,494,268 B1
(45) Date of Patent: Dec. 17, 2002

(54) TRANSPORT AND SUPPORT FRAME FOR A BOP ASSEMBLY

(75) Inventors: Patrick M. Ljungdahl, Kingwood, TX (US); Ira Glenn Harper, Jr., Houston, TX (US); Court Adkins, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/692,513

(22) Filed: Oct. 19, 2000

(51) Int. Cl.[7] ..... E21B 19/00; E21B 33/06; E21B 41/04

(52) U.S. Cl. ..... 166/379; 166/334; 166/360; 166/85.4; 405/224.4

(58) Field of Search ..... 166/268, 351, 166/360, 339, 379, 85.4, 85.5, 75.11; 405/224.2, 224.4

(56) References Cited

U.S. PATENT DOCUMENTS

| | | | | | |
|---|---|---|---|---|---|
| 3,498,375 | A | * | 3/1970 | McEwen et al. | 166/79.1 |
| 3,902,554 | A | * | 9/1975 | Hooper | 114/264 |
| 4,007,782 | A | * | 2/1977 | Nybo et al. | 166/79.1 |
| 4,108,318 | A | | 8/1978 | Rode et al. | 214/1 R |
| 4,147,221 | A | * | 4/1979 | Ilfrey et al. | 166/339 |
| 4,230,190 | A | | 10/1980 | Guinn et al. | 175/5 |
| 4,286,665 | A | * | 9/1981 | Walker | 166/339 |
| 4,437,521 | A | * | 3/1984 | Richardson et al. | 166/341 |
| 4,438,817 | A | * | 3/1984 | Pokladnik et al. | 166/341 |
| 4,518,042 | A | * | 5/1985 | Miller | 166/341 |
| 4,580,628 | A | * | 4/1986 | Schaeper | 166/379 |
| 4,630,680 | A | * | 12/1986 | Elkins | 166/341 |
| 4,702,320 | A | | 10/1987 | Gano et al. | 166/343 |
| 4,732,215 | A | * | 3/1988 | Hopper | 166/341 |
| 5,025,865 | A | * | 6/1991 | Caldwell et al. | 166/339 |
| 5,775,417 | A | * | 7/1998 | Council | 166/77.3 |
| 5,775,845 | A | | 7/1998 | Wybro | 405/195.1 |

FOREIGN PATENT DOCUMENTS

| | | | |
|---|---|---|---|
| EP | 1 103 459 | 5/2001 | B63B/35/44 |
| GB | 1 590 387 | 6/1981 | E21B/7/12 |
| WO | WO 00/34618 | 6/2000 | E21B/19/00 |

OTHER PUBLICATIONS

PCT International Search Report from International Application No. PCT/GB01/04356, Dated Apr. 12, 2002.

* cited by examiner

*Primary Examiner*—David Bagnell
*Assistant Examiner*—Jennifer H Gay
(74) *Attorney, Agent, or Firm*—Moser, Patterson & Sheridan, L.L.P.

(57) ABSTRACT

A method and apparatus is provided to prevent axial twisting, vibration, and bounce of individual components comprising a stack of operational surface components for a well which may occur during the transportation, hoisting, or use of the stack. A transport and support frame is provided which comprises a plurality of substantially vertical members, a plurality of substantially horizontal members interconnecting the vertical members, and a support structure to secure the stack within the frame.

15 Claims, 6 Drawing Sheets

TRANSPORT AND SUPPORT FRAME FOR A BOP ASSEMBLY

BACKGROUND OF THE INVENTION

1. Field of the Invention

The present invention relates to a stack of operational surface components for use with an oil or gas well. More particularly, the present invention relates to a transport and support frame for a blow-out preventer stack.

2. Background of the Related Art

A manifold having a series of valves and piping is typically used to contain the pressure of a reservoir, shut in a well, or control a production flow rate of a well. Commonly known manifolds include sub-sea wellheads, Christmas trees, and blow-out preventer (BOP) stacks. A BOP stack, in particular, comprises one or more BOPs to maintain oil, gas, mud, or other fluids within a well. BOPs are used to prevent unwanted or accidental exposure of pressurized fluids or gases during the drilling or workover of a well. In a well workover, for example, BOPs allow the well operator to insert and remove tubing or drill pipe within a wellbore while maintaining pressure in and around the tubulars.

BOPs are pressure containment and safety devices specifically designed to arrest the flow of a fluid or gas through a tubular or to seal an annular space between two coaxially arranged tubulars. There are numerous types of BOPs commercially available such as annular and blind types, for example. Annular type BOPs close off and seal annular spaces between coaxially arranged tubulars. Blind or "shear" type BOPs completely close off a well bore by crushing and/or shearing tubulars.

BOPs are typically vertically "stacked" to provide an effective and safe shut-off or isolation of any number of tubulars or annular areas within a wellbore. At least two BOPs are required to selectively seal an area around a tubular while permitting the passage of tools or connection joints into the well. Often times, a BOP stack consists of at least one blind ram, and at least one safety ram. The number of blind and safety rams are dependent on the working pressure of the wellbore. During a live well workover of the wellbore, a BOP stack will usually consist of at least two stripping rams in addition to the blind and safety rams. As a result, a BOP stack is often tall in relation to the other well surface equipment which makes the assembly, transportation, and servicing of the stack difficult for the well service company or operator.

A BOP stack may be pre-assembled and then transported to a wellsite. However, the assembled stack is rigid and brittle due to its height, making the stack susceptible to becoming loose or breaking at one or more interfaces between the individual BOPs. Most often, the BOP stack is jolted and bounced during transportation to a job site so that the connected flanges loose a fluid tight seal. Consequently, the BOP stack must then be re-tightened, re-inspected, and re-tested once installed at the job site.

Alternatively, the individual components of a BOP stack may be transported to and assembled at the wellsite. However, the assembly and disassembly of the individual components at the wellsite requires extensive man power and costly time because the size and shape of the stack severely restricts personnel access. Scaffolding is therefore separately assembled and disassembled to facilitate the assembly and disassembly of the stack.

Moreover, access to the individual components comprising the stack creates a problem once the stack assembly is completed or the pre-assembled stack is installed. A BOP stack requires frequent manipulation of its components throughout its use for which, service personnel need some type of scaffolding or other access to the stack. Proper access is required for safety considerations and also to prevent any damage to the stack itself which may result from climbing on the stack.

Therefore, there is a need for a method and apparatus for safely and easily transporting a pre-assembled BOP stack to a job site. There is a further need for a protective assembly around a completed BOP stack to facilitate the transportation of the stack to a wellsite. There is still a further need for an apparatus to protect an assembled BOP stack during transportation to a wellsite and to facilitate the use and maintenance of the BOP stack at the wellsite.

BRIEF SUMMARY OF THE INVENTION

A method and apparatus is provided to permit safe assembly, transportation, and use of a stack of operational surface components. In one aspect, a transport and support frame is provided which is constructed and arranged to be disposed about the stack to prevent axial twisting, vibration, and bouncing of the individual components comprising the stack which may occur during the transportation, hoisting, or use of the stack. The transport and support frame holds the stack firmly, thereby reducing damage and eliminating valuable time and manpower to re-tighten and re-align the individual components of the stack.

In another aspect, the transport and support frame comprises a plurality of vertical members each having an upper end and a lower end, a plurality of upper horizontal members interconnecting the upper ends of the vertical members, a plurality of horizontal members interconnecting the lower ends of the vertical members, and a support structure to secure the stack within the frame. At least one bar is disposed through a plurality of apertures formed within at least one interior attachment member of the stack. The support structure comprises a plurality of horizontal members each having a first end and a second end wherein the first end is secured to the vertical members of the frame and the second end is secured to the bars. The support structure also comprises a plurality of diagonal members each having a first end and a second end wherein the first end is secured to the vertical members and the second end is secured to the bars or horizontal members.

A method of attaching a stack of operational surface components to a transport and support frame is also provided. The method comprises disposing an attachment member having a plurality of apertures formed in an outer surface thereof within the stack, inserting at least one bar within each apertures, and securing the bar to a support structure comprising: a plurality of vertical members each having an upper end and a lower end; a plurality of upper horizontal members interconnecting the upper ends of the vertical members; a plurality of lower horizontal members interconnecting the lower ends of the vertical members; a plurality of diagonal support members extending from the vertical members toward an interior of the frame; and a plurality of horizontal support members extending from the vertical members toward the interior of the frame.

In another aspect, an attachment member is provided that may be disposed on a riser, thereby providing a means for tensioning the riser from an offshore platform above.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
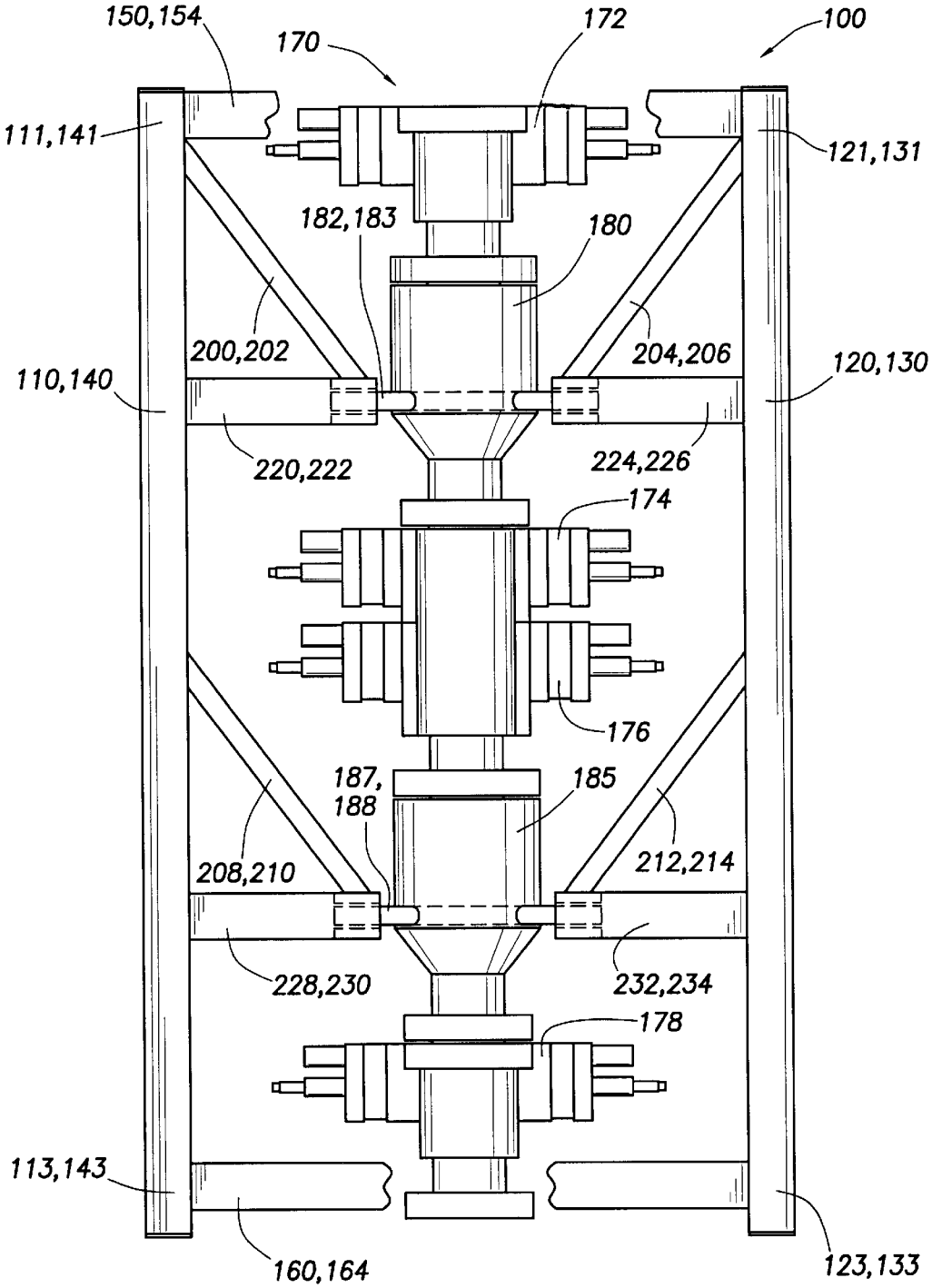
FIG. 1 is a side view of a blow-out preventer stack disposed within a transport and support frame.

A transport and support frame is provided to prevent axial twisting, vibration, and bounce of individual components comprising a stack of operational surface components for a well which may occur during the transportation, hoisting, or use of the stack. The transport and support frame 100 comprises a plurality of vertical members each having an upper end and a lower end, a plurality of upper horizontal members interconnecting the upper ends of the vertical members, a plurality of horizontal members interconnecting the lower ends of the vertical members, and a support structure to secure the stack within the frame. One aspect of the transport and support frame 100 is shown is FIGS. 1–4 which show a side view, an end view, a partial isometric view, and a top view of a transport and support frame 100, respectively.

As shown in FIGS. 1–4, the transport and support frame 100 includes four vertical members 110, 120, 130, and 140, each having an upper end 111, 121, 131, and 141, and a lower end 113, 123, 133, and 143. The upper ends 111, 121, 131, and 141 of the vertical members 110, 120, 130, and 140, are interconnected by four upper horizontal members 150, 152, 154, and 156. The lower ends 113, 123, 133, and 143, of the vertical members 110, 120, 130, and 140, are also interconnected by four lower horizontal members 160, 162, 164, and 166, thus forming a six-sided, open-faced box or frame.

The transport and support frame 100 is constructed and arranged to be disposed about a stack of operational surface components for a well. The stack may be, for example, a sub-sea wellhead, a wellhead Christmas tree, or a blow-out preventer (BOP) stack. However, for simplicity and ease of description, a transport and support frame according to this invention will be described as it relates to a BOP stack. A BOP stack typically comprises at least two blow-out preventers and more typically comprises two stripper rams, a blind ram, and a safety ram.

Figure 2:
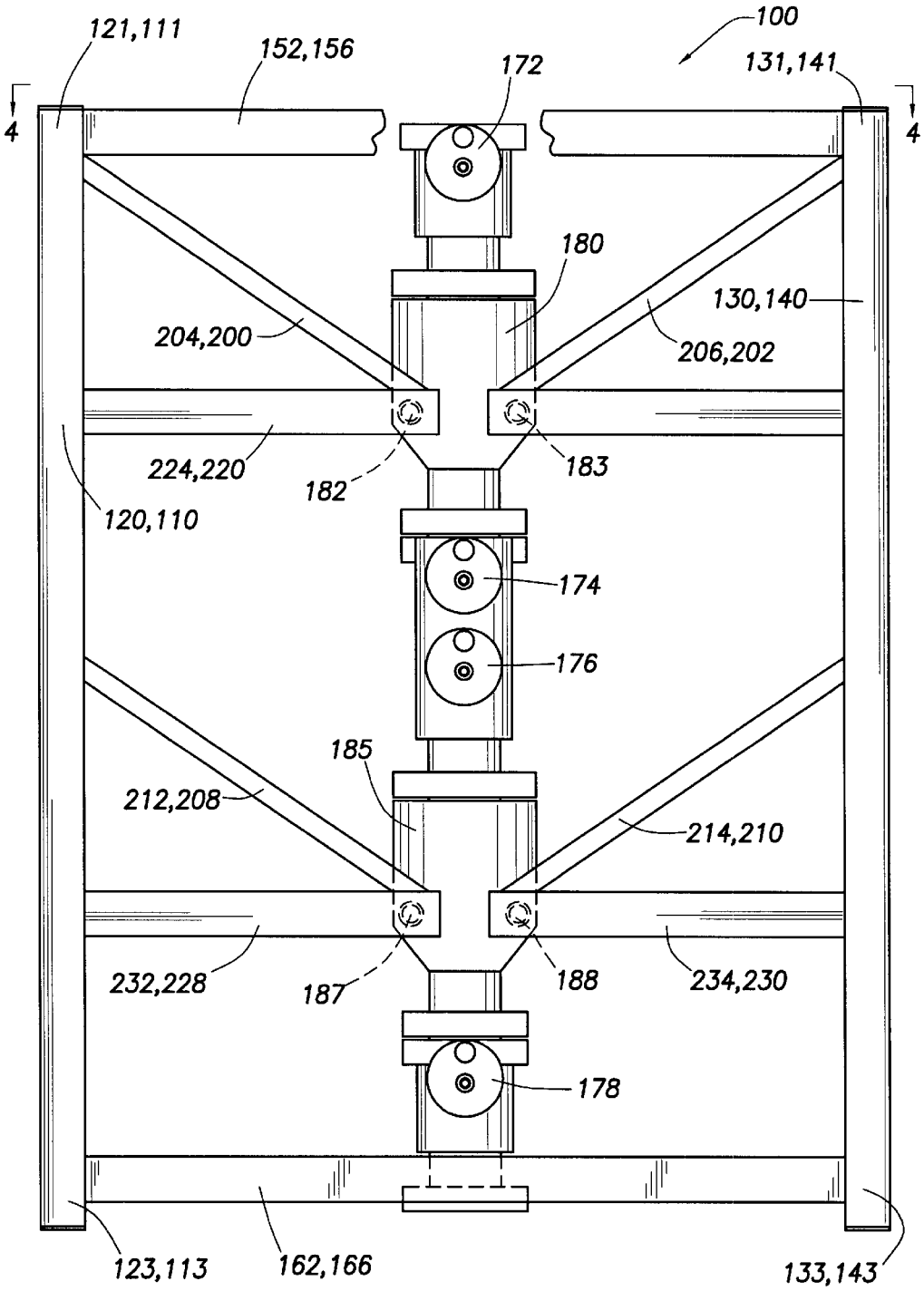
FIG. 2 is an end view of the blow-out preventer stack disposed within the transport and support frame of FIG. 1 rotated 90 degrees left.

Referring to FIGS. 1 and 2, a BOP stack 170 is shown disposed within the transport and support frame 100. The BOP stack 170, as shown, includes two stripper rams 172 and 174, a blind ram 176, and a safety ram 178. The BOP 170 stack also includes at least one interior attachment member, preferably two 180 and 185, for fixing the stack to the frame there-around.

The interior attachment members 180 and 185 are preferably spaced throughout the stack. For example, one interior attachment member 180 may be disposed between the stripper rams 172 and 174, and the second interior attachment member 185 may be disposed between the blind ram 176 and the safety ram 178. The interior attachment members 180 and 185 each include a plurality of horizontal apertures, preferably at least two, formed in an outer surface thereof to provide a housing for horizontal bars 182, 183, 187, and 188, which can be inserted through and removed from the apertures. In one aspect, the interior attachment member 180 and 185 is a pipe spool having an oversized wall thickness to form the horizontal apertures (not shown) there-through which does not compromise the minimum wall thickness or material properties requirement of the pipe spool. In another aspect, the interior attachment members 180 and 185 may be formed in an upper or lower flange of the four rams 172, 174, 176, 178. In this aspect, the ram includes a flange having an extended diameter and oversized thickness so that the horizontal apertures may be formed (not shown) there-through. In yet another aspect, the interior attachment members 180 and 185 may be any combination of a pipe spool and flange as described above.

A support structure secures the BOP stack 170 to the frame 100. The support structure includes a plurality of diagonal support members 200, 202, 204, 206, 208, 210, 212, and 214, and horizontal support members 220, 222, 224, 226, 228, 230, 232, and 234. The diagonal and horizontal support members are each attached to the vertical members 110, 120, 130, and 140, at a first end and each angled toward an interior of the frame 100 at a second end. The support members are angled towards the interior of the frame for attachment to the horizontal bars 182,183, 187, and 188.

The diagonal support members 200, 202, 204, 206, 208, 210, 212, and 214, and horizontal support members 220, 222, 224, 226, 228, 230, 232, and 234 of the support structure may be attached to the vertical members 110, 120, 130, and 140 by any well known or conventional method. For example, support members may be permanently fixed by welding the first ends to the vertical members. Alternatively, the support members may be bolted of otherwise flxably secured to the vertical members 110, 120, 130, and 140 to allow the support members to be moved or adjusted to the particular requirements of the stack disposed within the frame 100.

The diagonal support members 200, 202, 204, 206, 208, 210, 212, and 214, and horizontal support members 220, 222, 224, 226, 228, 230, 232, and 234 of the support structure may be secured or attached to the horizontal bars 182, 183, 187, and 188 at their second ends by any well known or conventional method. The diagonal support members 200, 202, 204, 206, 208, 210, 212, and 214, horizontal support members 220, 222, 224, 226, 228, 230, 232, and 234, and horizontal bars 182,183, 187, and 188, may each include aligning holes (not shown) formed there-through to provide a point of attachment wherein a screw or bolt (not shown) may be disposed within the aligning holes and securely fastened to fix the members together. Alternatively, the diagonal support members 200, 202, 204, 206, 208, 210, 212, and 214, and horizontal support members 220, 222, 224, 226, 228, 230, 232, and 234 of the support structure may be welded together as shown in FIG. 3.

Figure 3:
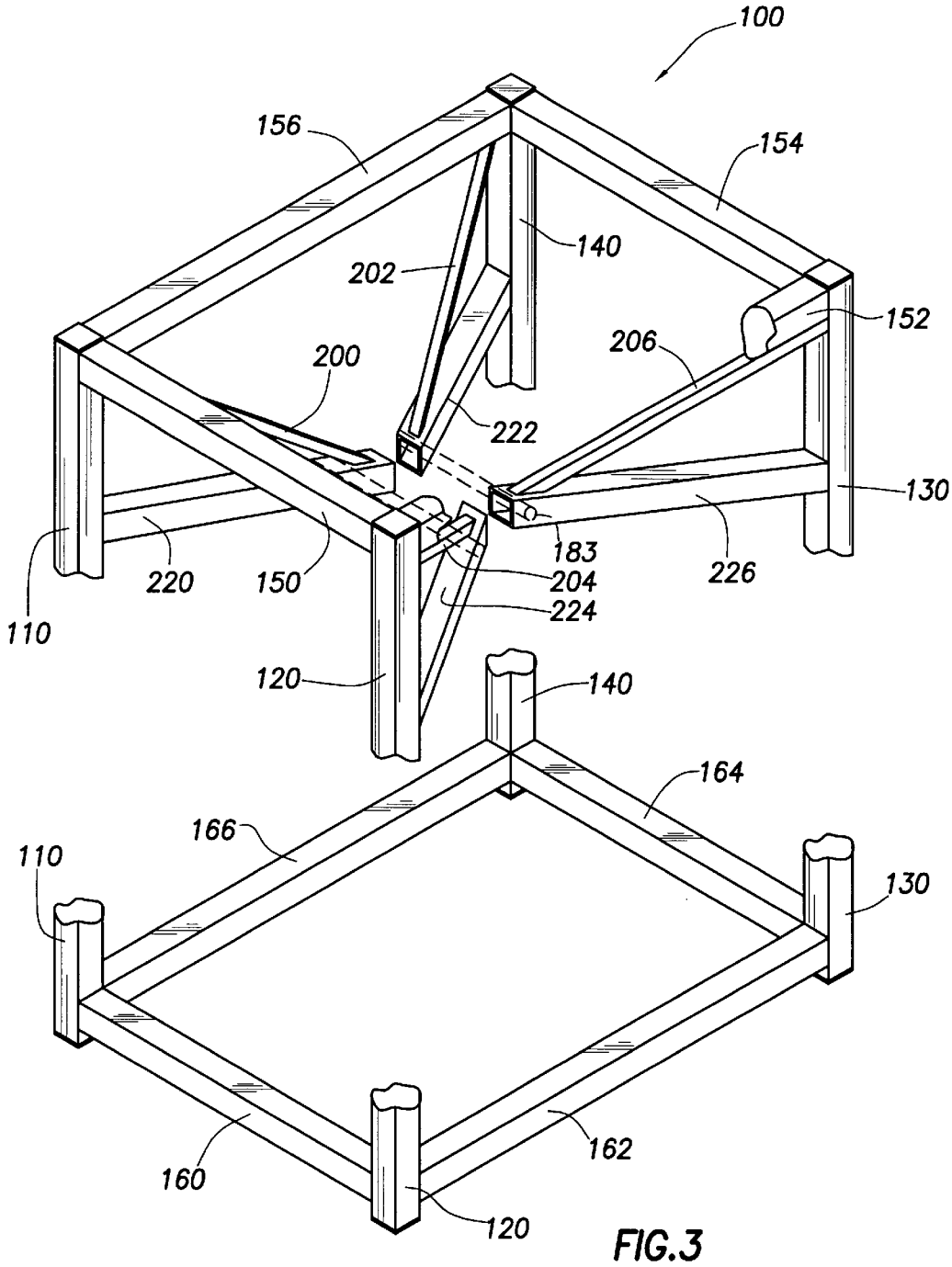
FIG. 3 is a partial isometric view of the transport and support frame of FIGS. 1 and 2.
Figure 4:
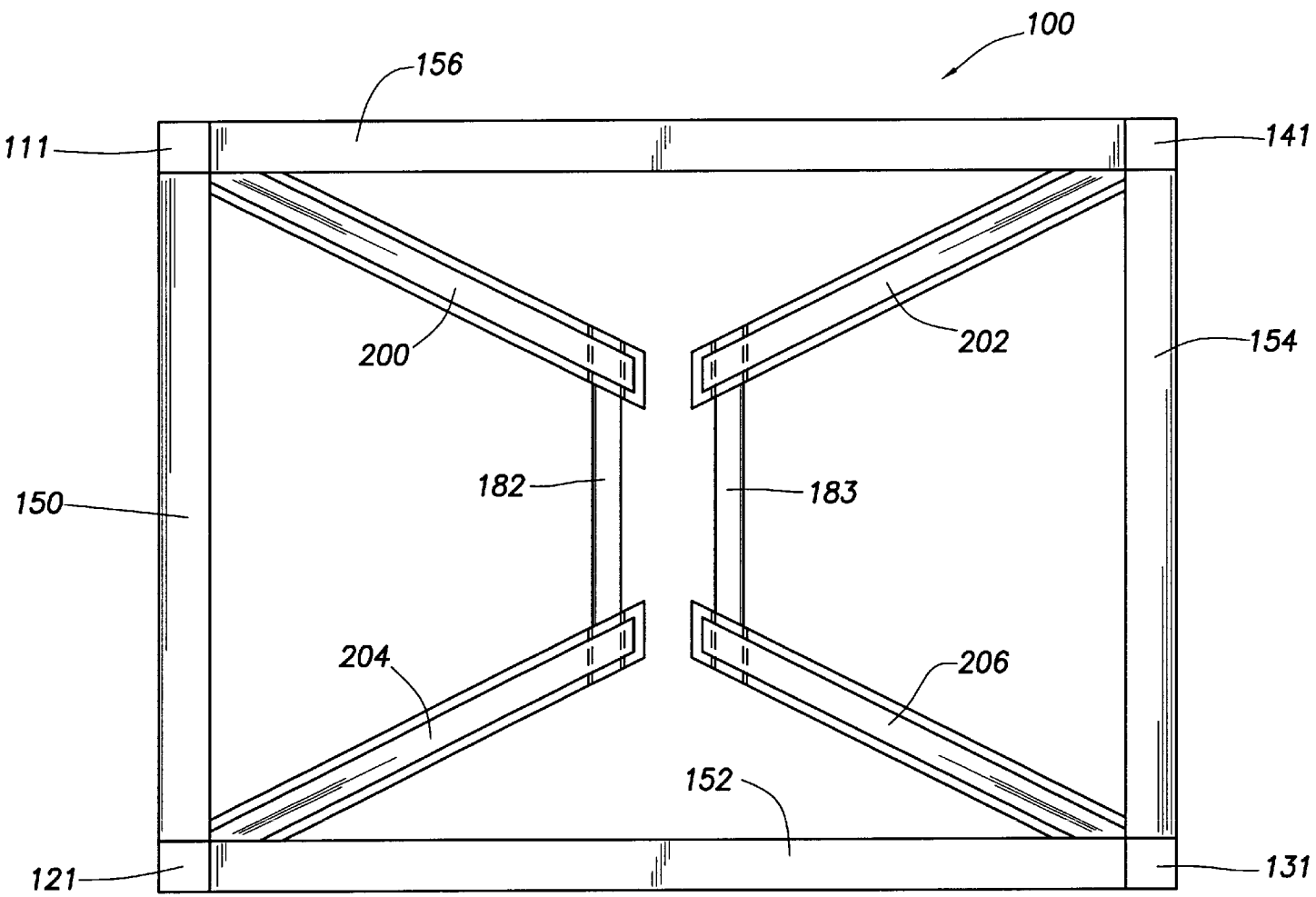
FIG. 4 is a top view of the transport and support frame shown along lines 3—3 of FIG. 2.

FIG. 3 shows an isometric view of the transport and support frame 100. As shown, the diagonal support members 200, 202, 204, and 206, are disposed on the horizontal members 220, 222, 224, and 226, each having an aligning hole disposed therein. The horizontal bars 182, 183, 187, and 188, are inserted through the aligning holes of the horizontal members 220, 222, 224, and 226, and securely fastened by any well-known and conventional method.

Figure 5:
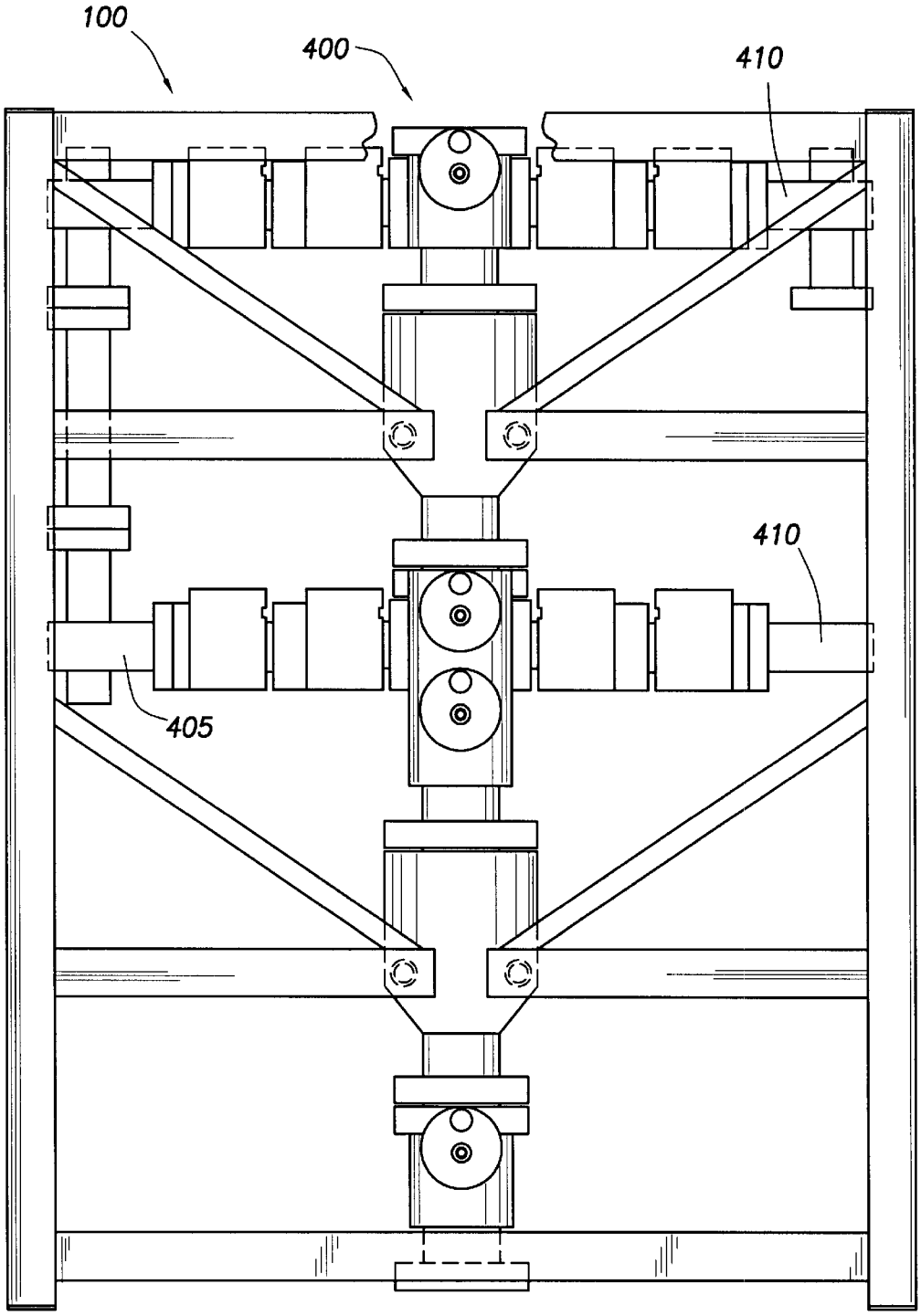
FIG. 5 is an end view of a fully assembled blow-out preventer stack having a bypass and other miscellaneous piping attached thereto disposed within the transport and support frame.

FIG. 5 is an end view of a fully assembled BOP stack 400 having an equalizing loop 405 and other miscellaneous piping 410 attached thereto disposed within the transport and support frame 100. As shown, the frame 100 has a cross-sectional area which is at least that of the fully assembled BOP stack 400 disposed therein. As a result, the assembled BOP stack 400 is fully enclosed within the transport and support frame 100. The frame 100 may also include a hoist connect member (not shown) such as an eyelet, for example, disposed on an upper surface of one or more of the vertical members 110, 120, 130, and 140. The hoist connect member is used to connect the frame 100 to a hoisting device such as a crane to facilitate lifting of the frame during transportation and installation at a wellsite.

Figure 6:
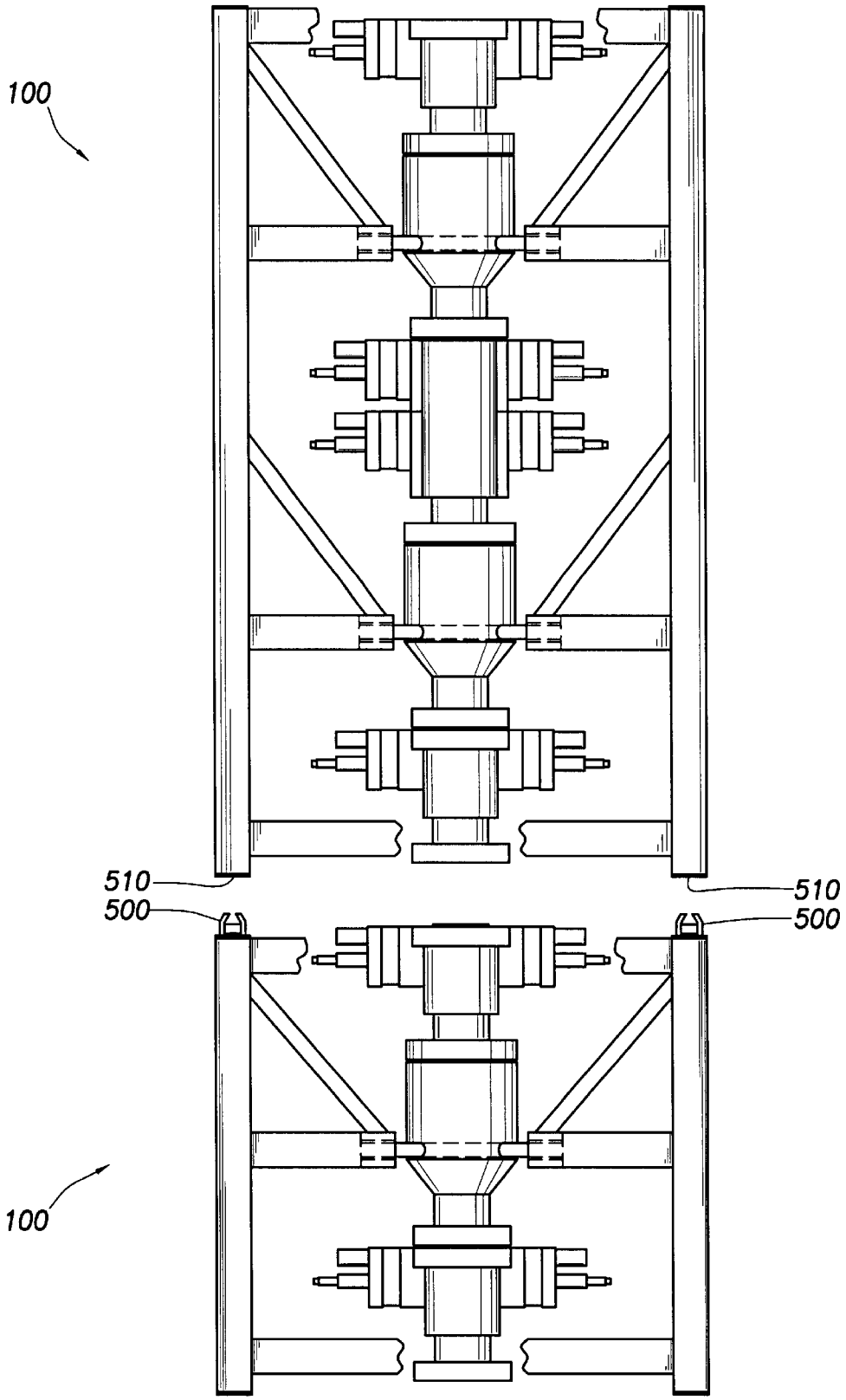
FIG. 6 is a side view of a stacked arrangement of the transport and support frame.

In addition, one or more frames 100 may be stacked together as shown in FIG. 6. FIG. 6 is a side view of a stacked arrangement of two transport and support frames 100. As shown, the frame 100 may include a male connect 500 disposed on an upper surface of the vertical members 110, 120, 130, and 140 which inserts into a female connect 510 disposed within a lower surface of the vertical members 110, 120, 130, and 140. It is believed that two or more frames 100 may be stacked however, any number of frames may be stacked depending on the height and weight restrictions of the transportation and hoisting equipment.

In use, (referring to FIGS. 1 and 2) the frame 100 is first constructed. The BOP stack 170 comprising the interior attachment members 180 and 185 is then inserted within the interior of the frame 100 or, alternatively, the BOP stack 170 is constructed therein. The horizontal bars 182, 183, 187, and 188 are inserted through the apertures formed within the upper interior attachment member 180 and the lower interior attachment member 185. The diagonal support members, horizontal support members, and horizontal bars are then bolted together. Last, any miscellaneous components or piping, such as an equalizing loop, are attached to the BOP stack 170.

Once the frame and stack installed therein arrives at a wellsite, the frame is installed on a wellhead in accordance with well known and conventional methods. Other components, like a snubbing unit, may be attached above the frame allowing drilling or workover operations to proceed as the frame provides support to the stack as well as access for personnel to the components comprising the stack. When the operation requiring the stack is complete, the wellhead and the stack are disconnected and the frame is lifted from the wellhead.

In addition to the aspects disclosed above, an interior attachment member 180 and 185 like those depicted in the FIGS. 1–6, may be disposed within a string of tubulars to provide a point of attachment to a support structure and a means for tensioning the string. For example, an attachment member having apertures formed therein may be disposed on the top of a string of tubulars making up an underwater riser. The apertures disposed in the attachment member provide a point of attachment for riser tensioners which are used to support the riser. In this manner, a riser tensioner can easily be connected to the attachment member disposed on a riser to support and tension the riser from a drill rig disposed on the ocean surface. The attachment member may be a pipe spool or a flange having an extended diameter and oversized thickness so that the apertures may be formed there-through.

While foregoing is directed to the preferred embodiment of the present invention, other and further embodiments of the invention may be devised without departing from the basic scope thereof, and the scope thereof is determined by the claims that follow.

What is claimed is:

1. A transport and support frame for disposal about a stack of operational surface components for a well, comprising:

a plurality of substantially vertical members;

a plurality of substantially horizontal frame members interconnecting the vertical members;

a plurality of substantially diagonal support members extending from the vertical members towards an interior of the frame for connection to the stack;

a plurality of substantially horizontal support members extending from the vertical members towards the interior of the frame for connection to the stack, wherein the stack comprises at least one interior attachment member having a plurality of apertures formed in an outer surface thereof, wherein the interior attachment member comprises a pipe spool, flange, or combination thereof; and at least one bar disposed through the apertures.

2. The frame of claim 1, wherein the stack is enclosed and securely fixed within the frame.

3. A method of attaching a stack of operational surface components to a transport and support frame, comprising;

disposing an attachment member having a plurality of apertures formed in an outer surface thereof within the stack;

inserting at least one bar within each aperture; and securing the bar to a support structure comprising:

a plurality of substantially vertical members;

a plurality of substantially horizontal members interconnecting the vertical members;

a plurality of substantially diagonal support members extending from the vertical members toward an interior of the frame; and a plurality of substantially horizontal support members extending from the vertical members toward the interior of the frame.

4. The method of claim 3, wherein the stack is a stack of blow-out preventers.

5. A transport and support frame for disposal about a stack of operational surface components for a well, comprising:

a plurality of substantially vertical members;

a plurality of substantially horizontal members interconnecting the vertical members; and a support structure to secure the stack within the frame, wherein the support structure includes:

a plurality of substantially horizontal support members each having a first end and a second end, wherein the first end is secured to one of the vertical members of the frame;

a plurality of substantially diagonal support members each having a first end and a second end, wherein the first end is secured to an upper corner of the frame;

at least one bar for disposal through an aperture formed in the stack, wherein the bar is secured to the diagonal support members.

6. The frame of claim 5, wherein the aperture is formed in an interior attachment member disposed in the stack.

7. The frame of claim 6, wherein the interior attachment member comprises a pipe spool, a flange, or combinations thereof.

8. A transport and support frame for disposal about a stack of operational surface components for a well, comprising:

a plurality of substantially vertical members;

a plurality of substantially horizontal members interconnecting the vertical members;

a plurality of substantially horizontal support members extending from the vertical members toward the interior of the frame for connection to the stack; and a plurality of substantially diagonal support members extending from the vertical members toward an interior of the frame for connection to the stack, wherein the stack comprises at least one interior attachment member having a plurality of apertures formed in an outer surface thereof; and a plurality of bars disposed through each aperture, whereby the stack is enclosed and securely fixed within the frame.

9. The frame of claim 8, wherein the bars are secured to the horizontal support members and diagonal support members.

10. A transport and support frame for disposal about a stack of operational surface components for a well, comprising:

a plurality of substantially vertical members;

a plurality of substantially horizontal members interconnecting the vertical members; and a plurality of substantially diagonal support members extending from the vertical members toward an interior of the frame for connection to the stack, wherein the stack is enclosed and securely fixed within the frame and remains secure during transport and the stack comprises at least one interior attachment member having a plurality of apertures formed in an outer surface thereof.

11. The frame of claim 10, wherein the interior attachment member comprises a pipe spool, flange, or combination thereof.

12. The frame of claim 10, further comprising a plurality of substantially horizontal support members extending from the vertical members toward the interior of the frame for connection to the stack.

13.The frame of claim 12, further comprising a plurality of bars disposed through each aperture.

14. The frame of claim 13, wherein the bars are secured to the horizontal support members and diagonal support members.

15. The frame of claim 12, wherein the horizontal support members are secured to the vertical members and are angled horizontally toward the interior of the frame.

* * * * *